US008246058B2

(12) United States Patent
Wang et al.

(10) Patent No.: US 8,246,058 B2
(45) Date of Patent: Aug. 21, 2012

(54) TURNING MECHANISM FOR SKATEBOARDS

(76) Inventors: Shiu-Chiung Wang, Ta-Li (TW); Chiung-Shih Liu, Ta-Li (TW)

( * ) Notice: Subject to any disclaimer, the term of this patent is extended or adjusted under 35 U.S.C. 154(b) by 476 days.

(21) Appl. No.: 12/609,894

(22) Filed: Oct. 30, 2009

(65) Prior Publication Data

US 2011/0101633 A1 May 5, 2011

(51) Int. Cl.
*A63C 17/00* (2006.01)

(52) U.S. Cl. ..... 280/11.28; 280/87.042

(58) Field of Classification Search ..... 280/87.042, 280/11.223, 11.27, 11.23, 11.26, 87.03, 87.041–43, 280/87.029, 47.12, 47.15, 11.19, 809; 301/125
See application file for complete search history.

(56) References Cited

U.S. PATENT DOCUMENTS

| | | | | |
|---|---|---|---|---|
| 4,159,830 | A * | 7/1979 | Solimine | 280/11.28 |
| 4,398,734 | A * | 8/1983 | Barnard | 280/11.28 |
| 5,114,166 | A * | 5/1992 | McCosker | 280/87.042 |
| 5,853,182 | A * | 12/1998 | Finkle | 280/87.042 |
| 5,975,546 | A * | 11/1999 | Strand | 280/87.042 |
| 6,467,782 | B1 * | 10/2002 | Smith | 280/87.042 |
| 6,616,155 | B2 * | 9/2003 | Tuan | 280/87.041 |
| 6,793,224 | B2 * | 9/2004 | Stratton | 280/87.042 |
| 6,981,710 | B2 * | 1/2006 | Cheng | 280/87.03 |
| 7,104,558 | B1 * | 9/2006 | Saldana | 280/87.042 |
| 7,243,925 | B2 * | 7/2007 | Lukoszek | 280/11.28 |
| 7,287,762 | B2 * | 10/2007 | Stratton | 280/11.27 |
| 7,341,260 | B1 * | 3/2008 | Hosoda et al. | 280/11.19 |
| 7,967,096 | B2 * | 6/2011 | Boyd et al. | 180/210 |
| 2002/0084602 | A1 * | 7/2002 | Feng | 280/11.223 |
| 2002/0125670 | A1 * | 9/2002 | Stratton | 280/87.041 |
| 2002/0167144 | A1 * | 11/2002 | Guang-Gwo | 280/87.041 |
| 2002/0195788 | A1 * | 12/2002 | Tierney et al. | 280/87.042 |
| 2004/0041360 | A1 * | 3/2004 | Lukoszek | 280/11.27 |
| 2005/0051983 | A1 * | 3/2005 | Williams | 280/87.042 |
| 2006/0006622 | A1 * | 1/2006 | Gesmer et al. | 280/87.042 |
| 2006/0097470 | A1 * | 5/2006 | Chmelar | 280/87.042 |
| 2006/0119062 | A1 * | 6/2006 | Lukoszek | 280/87.042 |
| 2007/0182118 | A1 * | 8/2007 | Cole | 280/87.042 |
| 2009/0160143 | A1 * | 6/2009 | Fraley | 280/11.28 |
| 2010/0327547 | A1 * | 12/2010 | Wilson et al. | 280/87.042 |

* cited by examiner

*Primary Examiner* — John Walters
*Assistant Examiner* — James Triggs

(57) ABSTRACT

A turning mechanism for skateboards includes a plate fixed to the underside of the board and a wheel frame is pivotably connected to the pivot tube on the plate. A first part extends through a lug on the plate and a second part is threadedly connected to the first part. A U-shaped first restriction member extends through a spring and is connected to the second part, and two hook ends of the first restriction member are hooked to a first end of the spring. A U-shaped second restriction member extends through the spring and is connected to a rod on the wheel frame. Two hook ends of the second restriction member are hooked to a second end of the spring. The second part moves linearly to pull the spring when rotating the first part so as to restrict the required force that the wheel frame is pivoted relative to the pivot tube.

19 Claims, 9 Drawing Sheets

TURNING MECHANISM FOR SKATEBOARDS

FIELD OF THE INVENTION

The present invention relates to a turning mechanism for skateboards, and more particularly, to an adjustable turning unit to control the turning angles between the wheel frame and the plate of the skateboard to meet requirements of performances of different levels of skill.

BACKGROUND OF THE INVENTION

A conventional skateboard includes two sets of wheels connected to two ends of the underside of the board and the user steps on one end and uses the other leg to kick the ground to move the skateboard. When turning, the user has to control his/her weight position and swings his/her body to control the skateboard to turn.

However, turning requires a lot of skill which is difficult for beginners and especially when turning on a slope ramp at high speed. The difficulties easily make the beginners give up and get injured when turning.

The present invention intends to provide a turning mechanism for skateboards and includes an adjustment unit which controls the turning angles of the wheel frame and the force required so as to allow the users to turn easily.

SUMMARY OF THE INVENTION

The present invention relates to a turning mechanism for skateboards, and the turning mechanism comprises a plate fixed to the underside of the board and has a lug with a through hole defined therethrough. A pivot tube extends from the plate at an angle and includes an axial hole through which an axle extends so as to be connected with a wheel frame. The wheel frame includes a pivot portion which is located corresponding to the pivot tube. A passage is defined axially through the pivot portion. An extension extends from the pivot portion and two shafts extend from two sides of the extension such that two wheels are connected to the two shafts. A rod extends from the extension. A common axis of the two shafts is located at a distance from the pivot tube.

An adjustment unit includes a first part, a second part and a spring, wherein the first part extends through the through hole and the second part is threadedly connected to the first part. The second part includes an aperture. A U-shaped first restriction member extends through the spring and the aperture and two hook ends of the first restriction member are hooked to a first end of the spring. A U-shaped second restriction member extends through the spring and two hook ends of the second restriction member are hooked to a second end of the spring. A U-shaped portion of the second restriction member is engaged with the rod on the extension. The first part includes an inner threaded hole defined in an end thereof and the second part is threadedly connected with the inner threaded hole of the first part. A U-shaped portion of the first restriction member extends through the aperture of the second part which moves linearly when rotating the first part so as to change a length of the spring.

The primary object of the present invention is to provide a turning mechanism that controls the compression level of the spring which is connected between the wheel frame and the pivot tube on the bottom of the board so that the force to turn the skateboard is controlled and adjustable.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
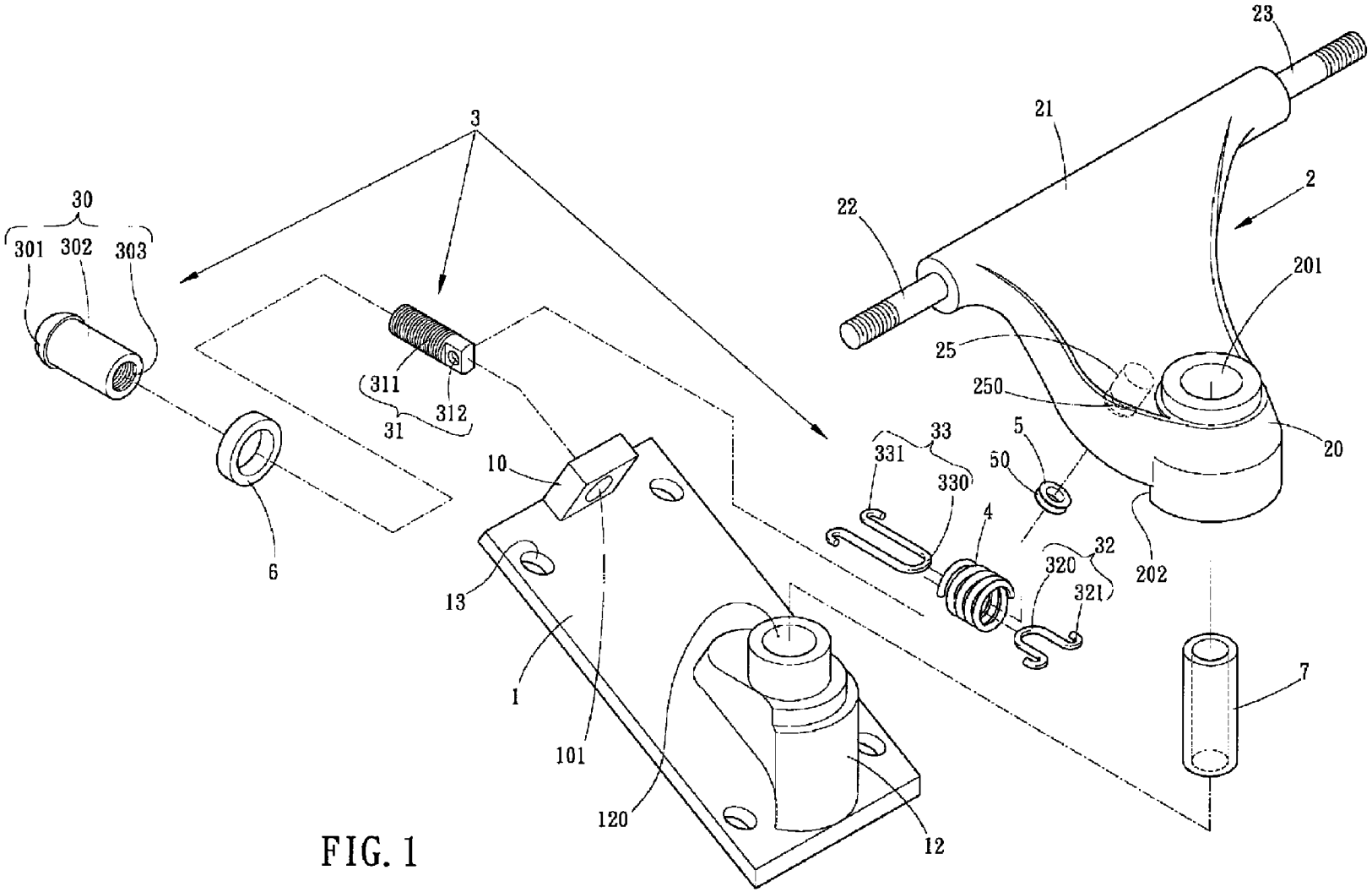
FIG. 1 is an exploded view to show the turning mechanism of skateboards of the present invention.
Figure 2:
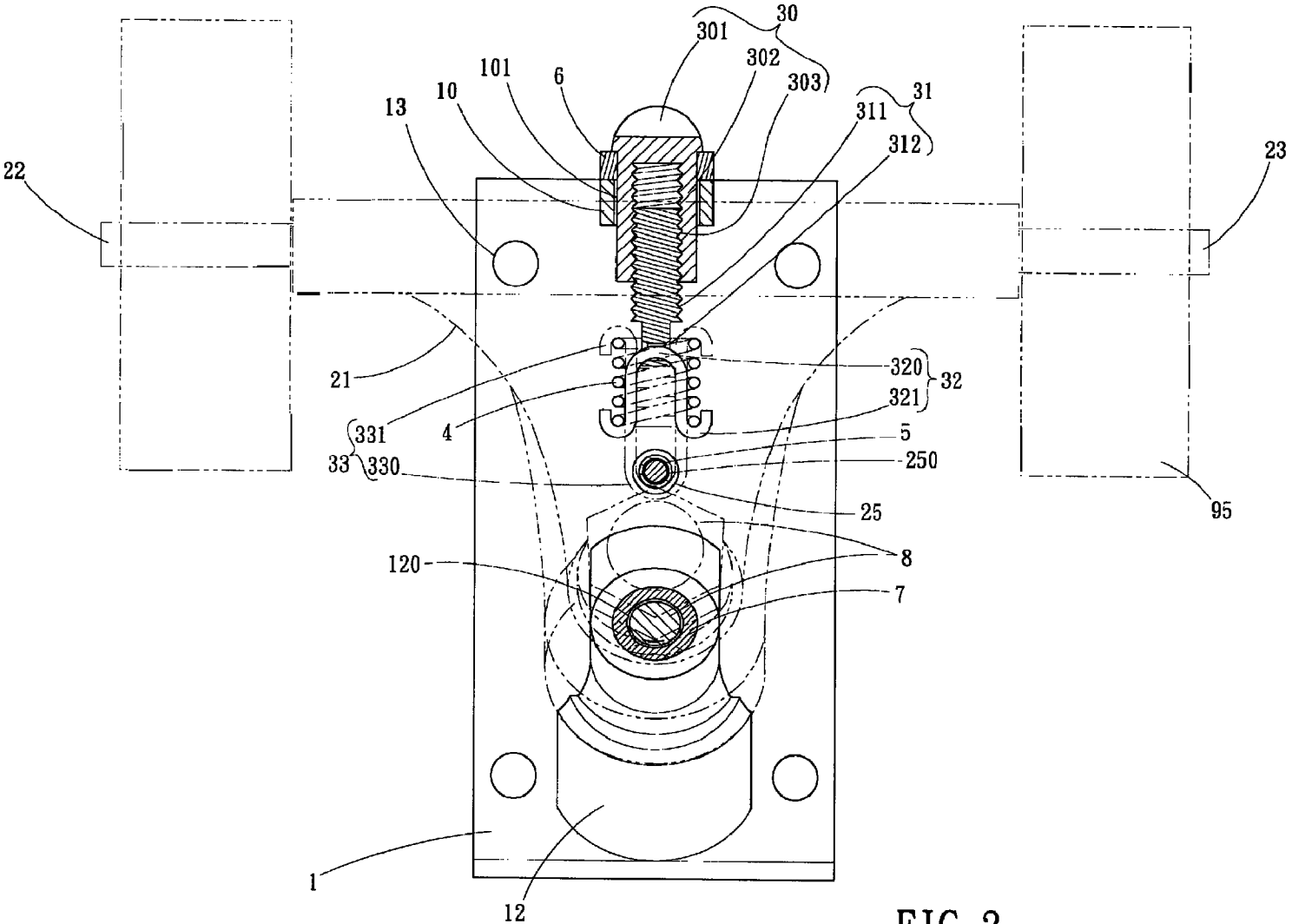
FIG. 2 is a partial cross sectional view to show the turning mechanism of skateboards of the present invention.
Figure 3:
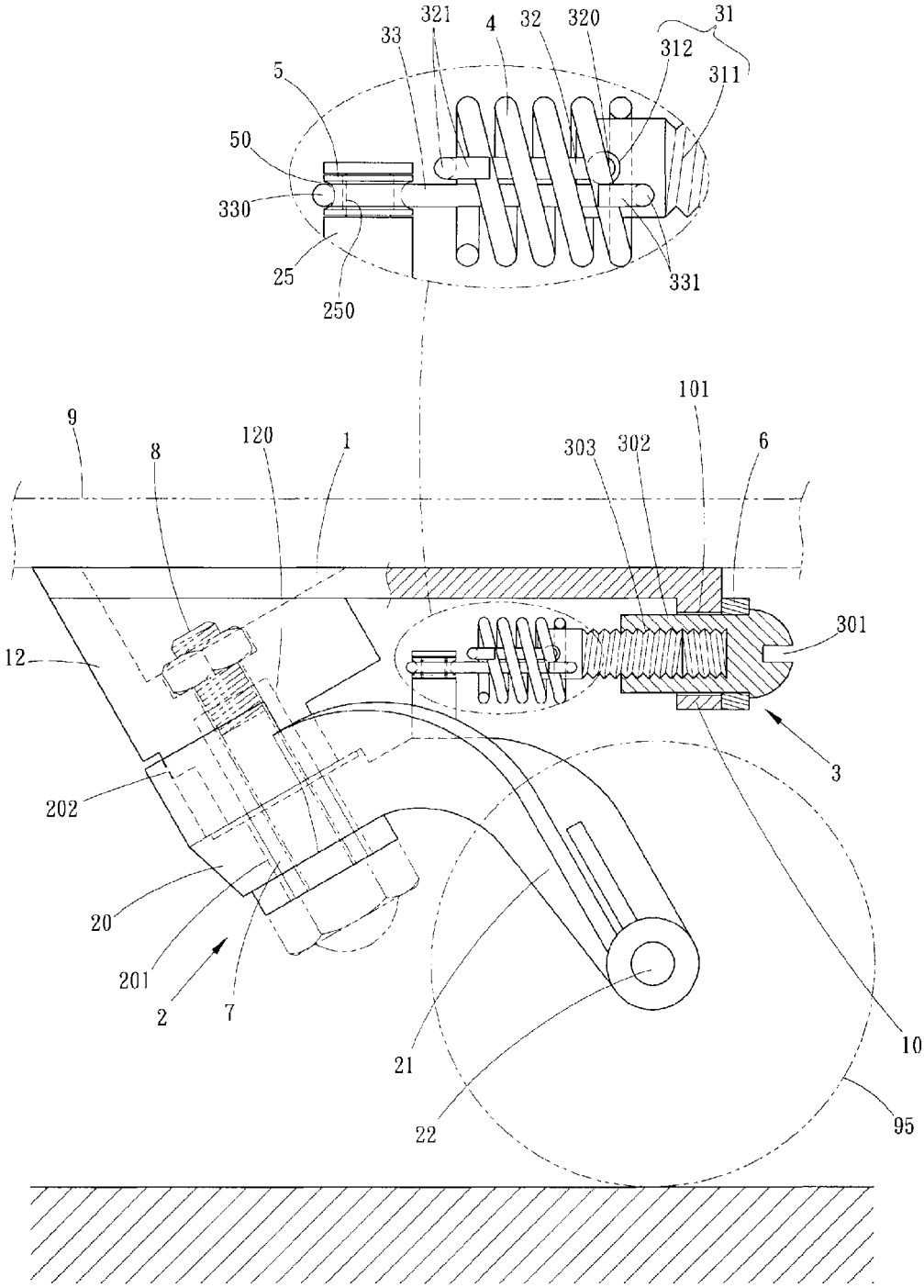
FIG. 3 is a side cross sectional view to show the turning mechanism of skateboards of the present invention.

Referring to FIGS. 1 to 3, the turning mechanism for skateboards of the present invention comprises a plate 1 having a lug 10 extending from a surface thereof and a through hole 101 is defined through the lug 10. The plate 1 includes four positioning holes 13 at four corners thereof such that the plate 1 is fixed to a board 9 by extending fixing members (not shown) such as screws or rivets through the positioning holes 13. A pivot tube 12 extends from the surface of the plate 1 at an angle and an axial hole 120 is defined through the pivot tube 12. A bush 7 is inserted into the axial hole 120 and an axle 8 extends through the bush 7 and the axial hole 120 in pivot tube 12 so as to be connected to a wheel frame 2. The wheel frame 2 includes a pivot portion 20 which is located corresponding to the pivot tube 12 and the axle 8 extends through a passage 201 defined axially through the pivot portion 20. An extension 21 extends from the pivot portion 20 and two shafts 22, 23 extend from two sides of the extension. The two shafts 22, 23 are connected with two wheels 95. A common axis of the two shafts 22, 23 is located at a distance from the pivot tube 12 and is not parallel to the axis of the pivot tube 12. A stop 202 extends axially from the pivot portion 20 so as to restrict an angle that the wheel frame 2 turns relative to the plate 1. A rod 25 extends from a surface of the extension 21 and a groove 250 is defined in an outer periphery of a distal end of the rod 25. A collar 5 is engaged with the groove 250 of the rod 25 and includes an annular groove 50 defined in an outer periphery thereof.

An adjustment unit 3 includes a first part 30, a second part 31 and a spring 4, wherein the first part 30 extends through the through hole 101 and the second part 31 is threadedly connected to the first part 30. The first part 30 includes an operation portion 301 at a first end thereof and a shank 302 extends from the operation portion 301. An inner threaded hole 303 is defined in a second end of the first part 30. The second part 31 has outer threads 311 which are threadedly connected with the inner threaded hole 303 of the first part 30 when the first part 30 extends through the through hole 101 of the lug 10. In this embodiment, the operation portion 301 is a slot such that a hand tool can be engaged with the slot to rotate the first part 30. A buffering ring 6 is located between the first part 30 and the plate 1 to reduce noise and absorb shaking. The second part 31 includes an aperture 312 defined in a distal end thereof.

A U-shaped first restriction member 32 extends through the spring 4 and the aperture 312 and two hook ends 321 of the first restriction member 32 are hooked to a first end of the spring 4. A U-shaped second restriction member 33 extends through the spring 4 and two hook ends 331 of the second restriction member 33 are hooked to a second end of the spring 4. The U-shaped portion 330 of the second restriction member 33 is engaged with the annular groove 50 of the collar 5 on the rod 25 of the extension 21. The U-shaped portion of the first restriction member 32 extends through the aperture 312 of the second part 31 such that when the first part 30 is rotated, the second part 31 moves linearly to pull the first restriction member 32 to change the compression and the length of the spring 4.

Figure 4:
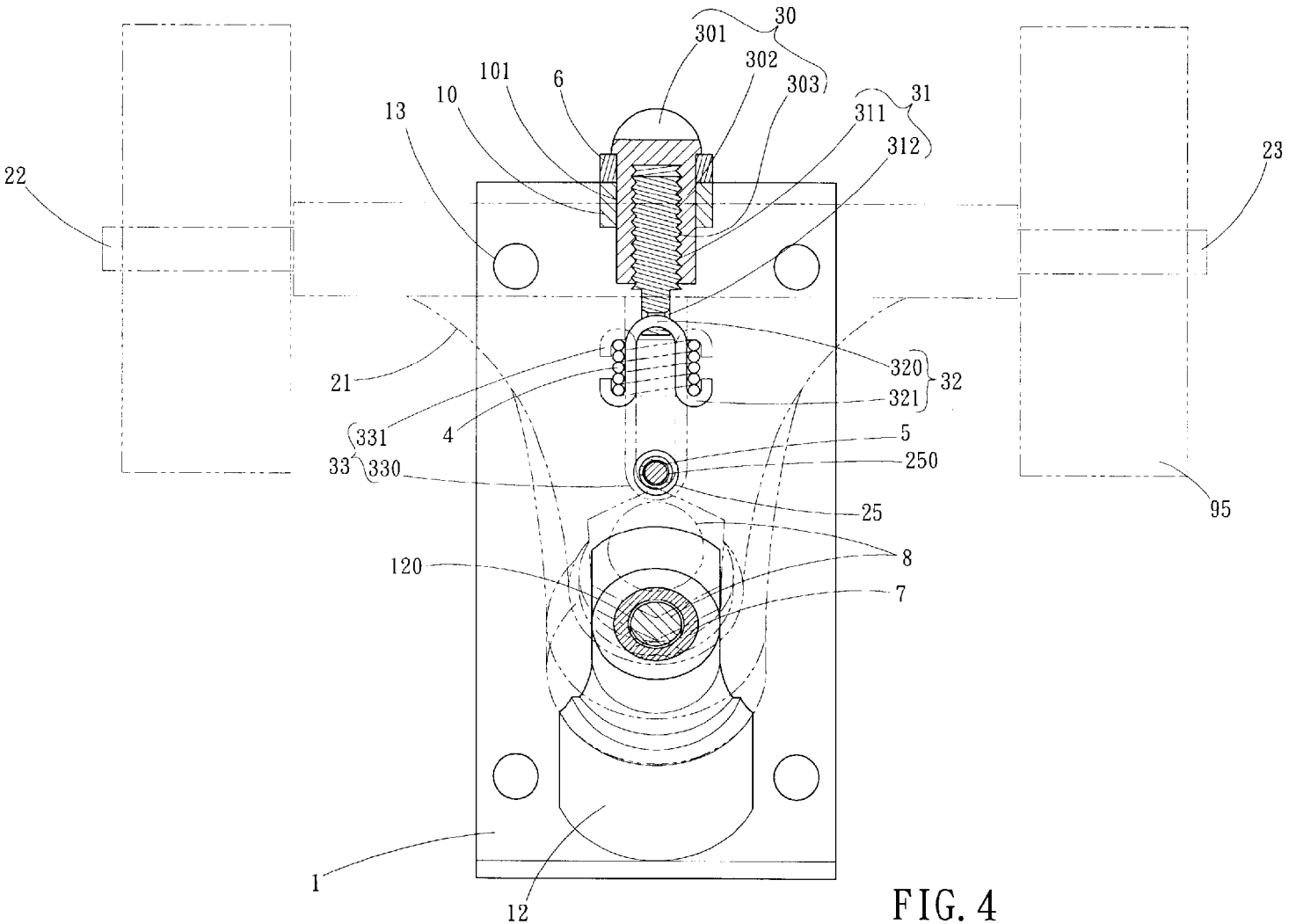
FIG. 4 is a partial cross sectional view to show that the spring is compressed and shortened by rotating the first part of the turning mechanism of the present invention.
Figure 5:
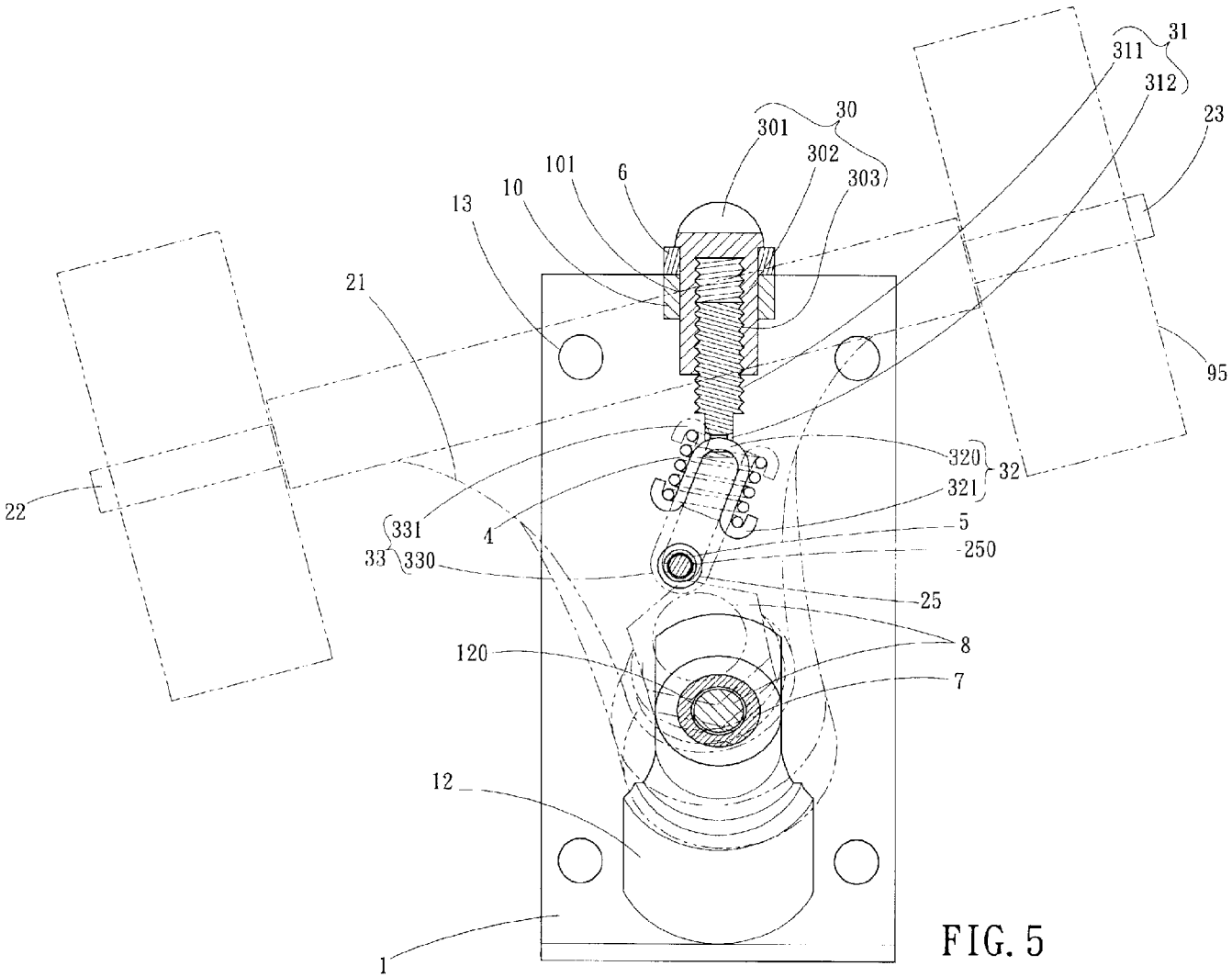
FIG. 5 shows that the wheel frame turns when the turning mechanism of the present invention is in the status in FIG. 2.
Figure 6:
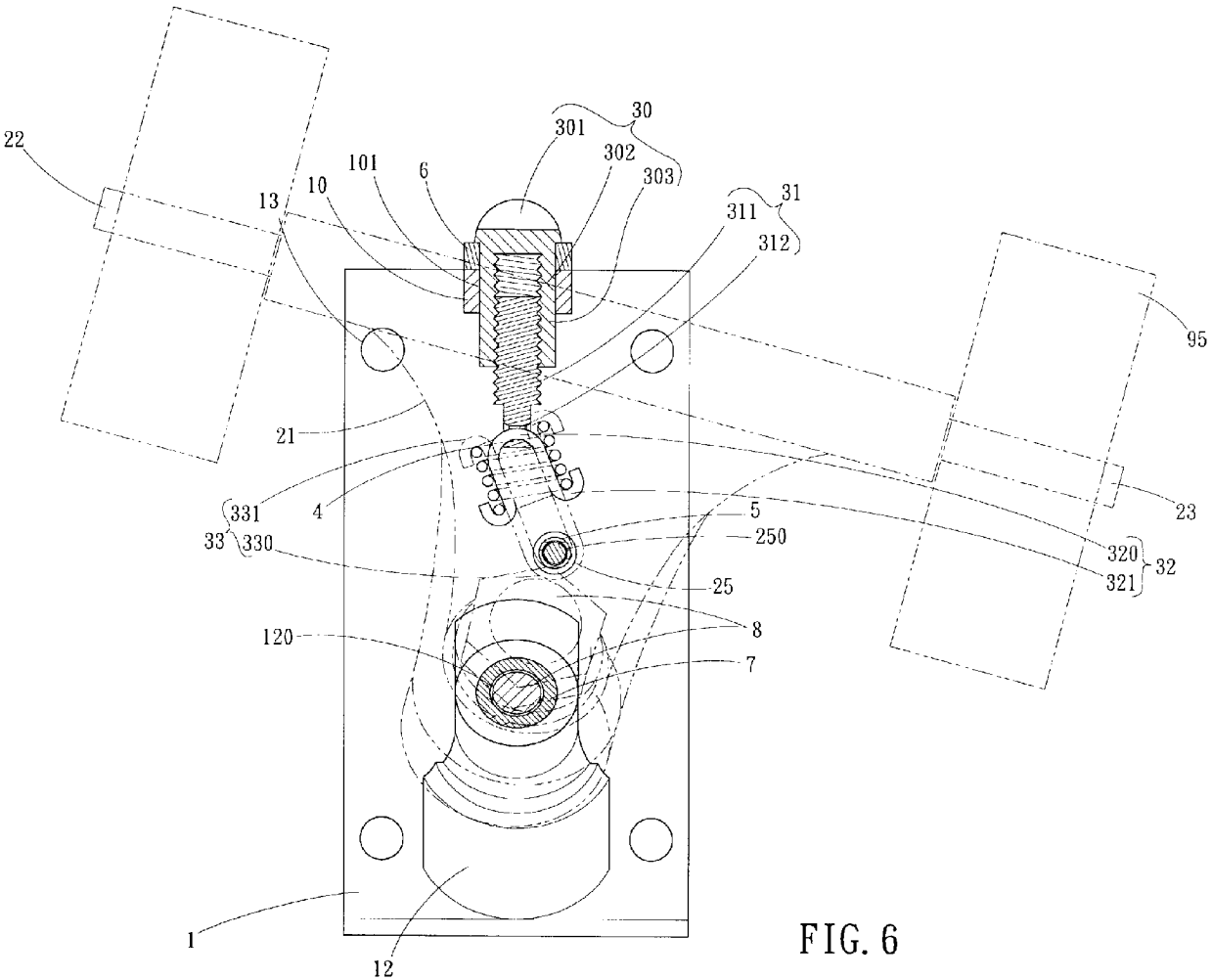
FIG. 6 shows that the wheel frame turns to the other direction when the turning mechanism of the present invention is in the status in FIG. 2.

Referring to FIGS. 4 to 6, when rotating the first part 30 to pull the second part 31, the hook ends 321 of the first restriction member 32 drag the end of the spring 4 toward the second part 31 while the second restriction member 33 does not move, such that the spring 4 is compressed until the spring 4 becomes a solid member. In this situation, the first restriction member 32, the spring 4 and the second restriction member 33 are connected to each other as one piece, so that the angle that the wheel frame 2 can turn relative to the plate 1 is minimized. This is suitable for beginners to learn how to keep balance and turns.

For the experienced users, the first part 30 is rotated to move the second part toward the pivot tube 12, the spring 4 is released so that the angle that the wheel frame 2 can turn relative to the plate 1 is maximized. The force that the spring 4 replied is the force required for turning the wheel frame 2 relative to the plate 1.

Figure 7:
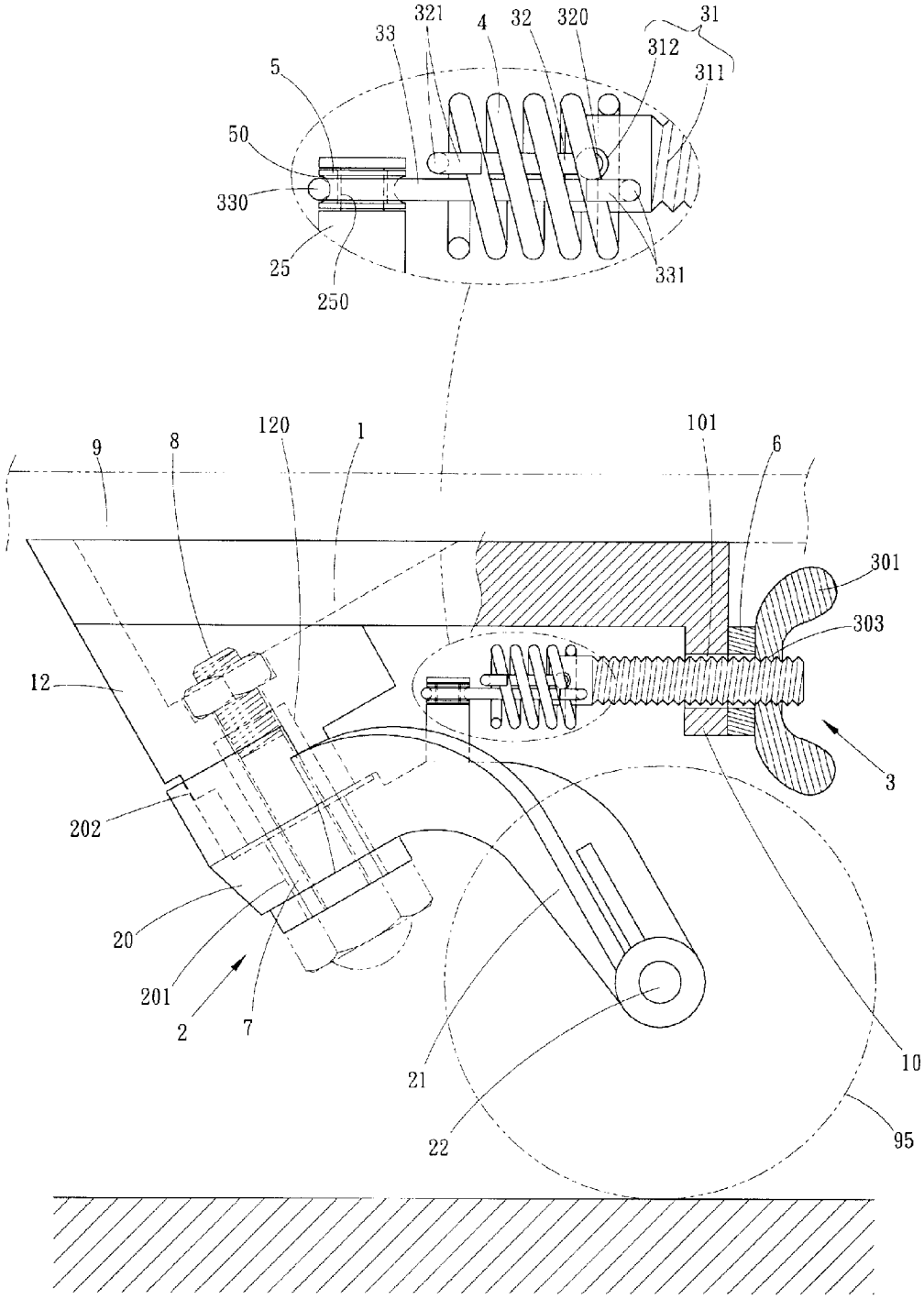
FIG. 7 is a cross sectional view to show the second embodiment of turning mechanism of the present invention.

FIG. 7 shows the second embodiment of the present invention, wherein the first part 30 becomes a locking nut and the operation portion 301 includes two wings between which the inner threaded hole 303 is defined. The second part 31 is threadedly connected to the inner threaded hole 303, such that when rotating the operation portion 301, the second part 31 is moved linearly.

Figure 8:
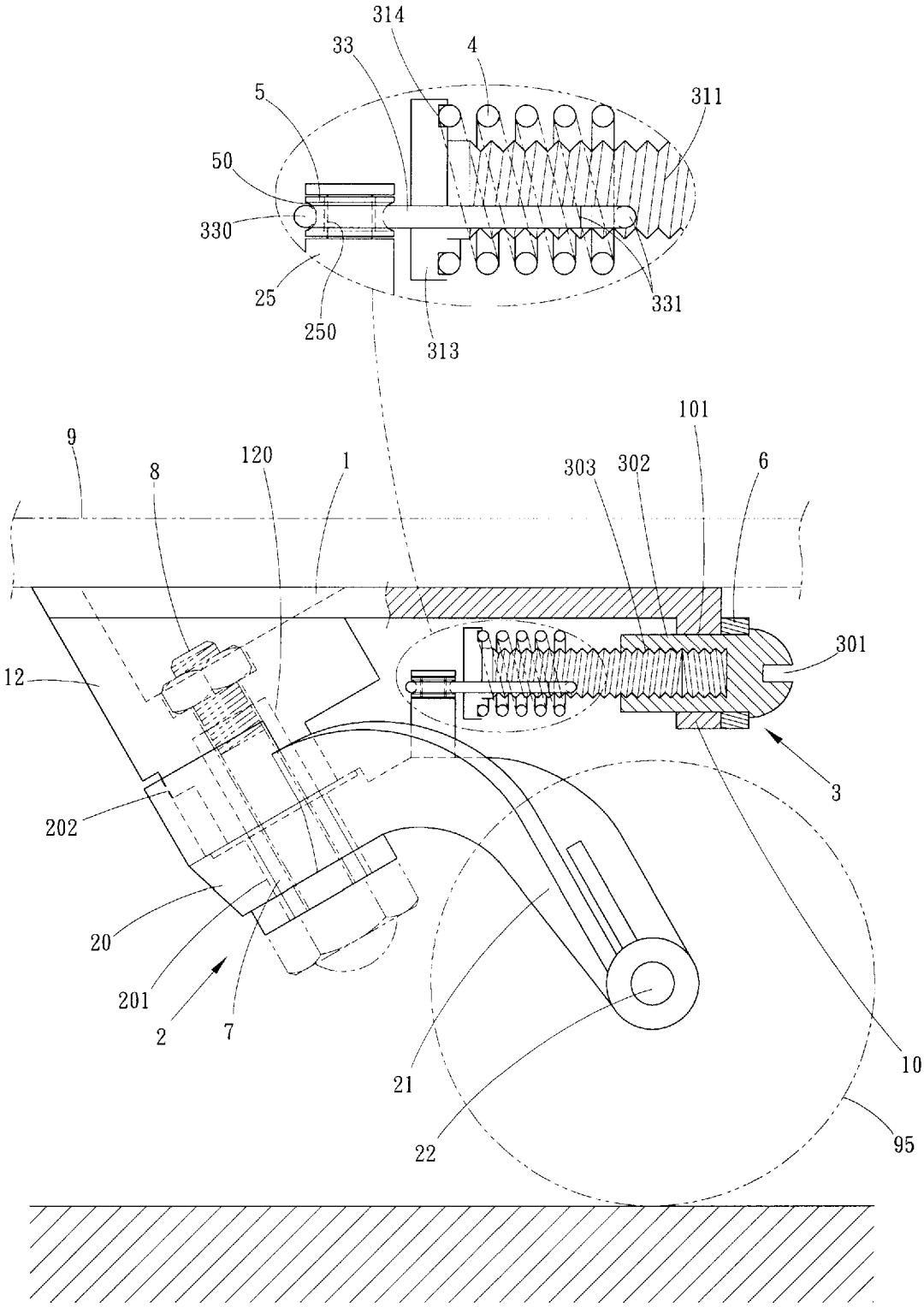
FIG. 8 is a cross sectional view to show the third embodiment of turning mechanism of the present invention.
Figure 9:
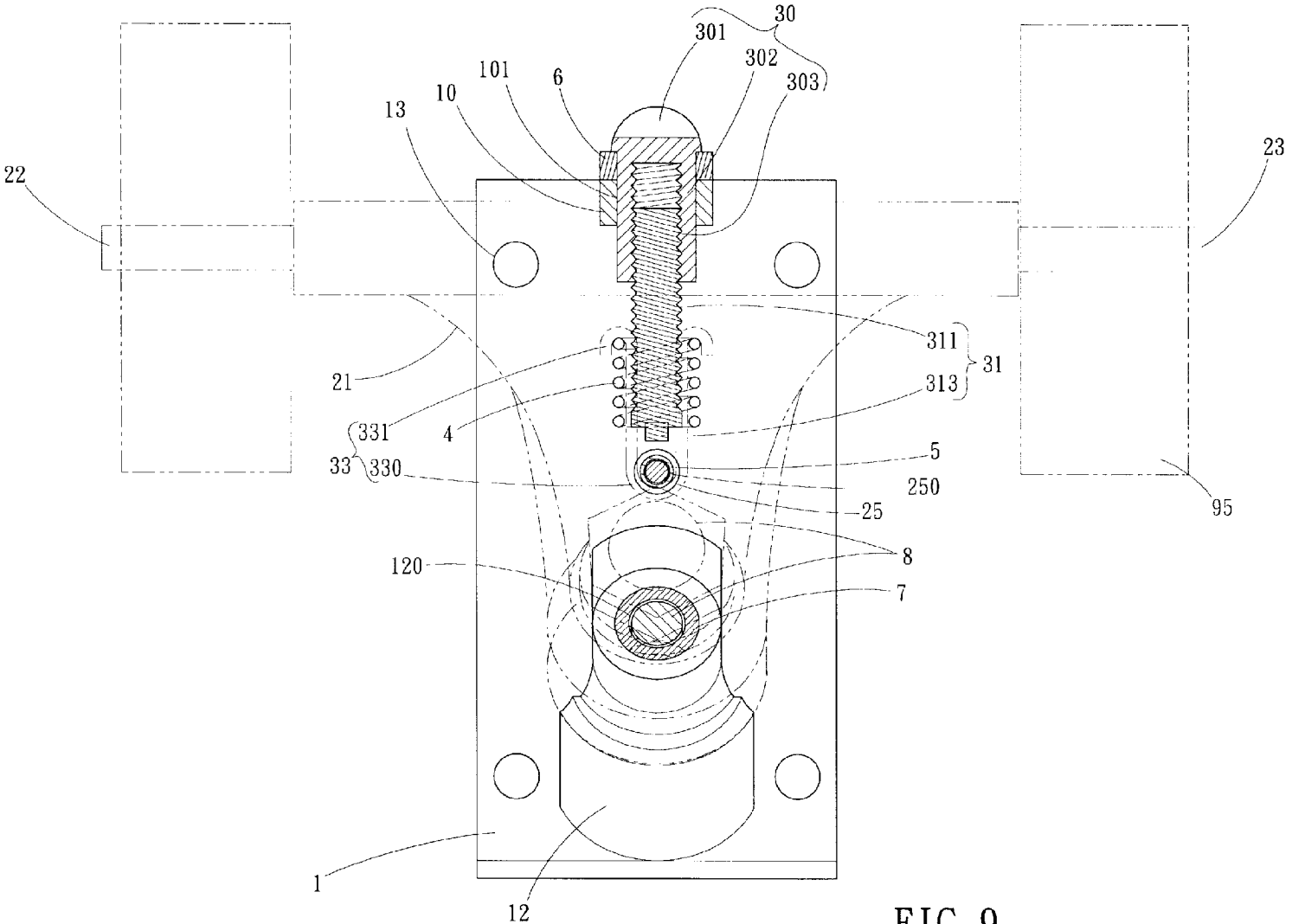
FIG. 9 is a bottom view of the third embodiment of turning mechanism of the present invention.

FIGS. 8 and 9 show the third embodiment of the present invention wherein the first part 30 is the same as that in the first embodiment, the difference is that the second part 31 includes a flange 313 at an end thereof and the flange 313 includes a recess 314 defined in a surface thereof such that the spring 4 is engaged with the recess 314. The flange 313 replaces the aperture 312 in the first embodiment.

While we have shown and described the embodiment in accordance with the present invention, it should be clear to those skilled in the art that further embodiments may be made without departing from the scope of the present invention.

What is claimed is:

1. A turning mechanism for skateboards, comprising:

a plate having a lug extending from a surface thereof and a through hole defined through the lug, a pivot tube extending from the surface of the plate at an angle and including an axial hole defined through the pivot tube, the plate adapted to be fixed to a board, an axle extending through the axial hole in pivot tube and connected to a wheel frame, the wheel frame including a pivot portion which is located corresponding to the pivot tube, a passage defined axially through the pivot portion, an extension extending from the pivot portion and two shafts extending from two sides of the extension, the two shafts adapted to be connected with two wheels, a rod extending from a surface of the extension, a common axis of the two shafts located at a distance from the pivot tube, and an adjustment unit including a first part, a second part and a spring, the first part extending through the through hole and the second part threadedly connected to the first part, the second part including an aperture, a U-shaped first restriction member extending through the spring and the aperture and two hook ends of the first restriction member being hooked to a first end of the spring, a U-shaped second restriction member extending through the spring and two hook ends of the second restriction member being hooked to a second end of the spring, a U-shaped portion of the second restriction member engaged with the rod on the extension, the first part including an operation portion at a first end thereof and a shank extending from the operation portion, an inner threaded hole defined in a second end of the first part, the second part having outer threads which are threadedly connected with the inner threaded hole of the first part, a U-shaped portion of the first restriction member extending through the aperture of the second part which moves linearly when rotating the first part so as to change a length of the spring.

2. The turning mechanism as claimed in claim 1, wherein a buffering ring is located between the first part and the plate.

3. The turning mechanism as claimed in claim 2, wherein the rod includes a groove defined in an outer periphery of a distal end thereof and the U-shaped portion of the second restriction member is engaged with the groove.

4. The turning mechanism as claimed in claim 3, wherein a collar is engaged with the groove of the rod and includes an annular groove defined in an outer periphery thereof, the U-shaped portion of the second restriction member is engaged with the annular groove.

5. The turning mechanism as claimed in claim 3, wherein a stop extends axially from the pivot portion so as to restrict an angle that the wheel frame turns relative to the plate.

6. The turning mechanism as claimed in claim 1, wherein the operation portion is a slot.

7. A turning mechanism for skateboards, comprising:

a plate having a lug extending from a surface thereof and a through hole defined through the lug, a pivot tube extending from the surface of the plate at an angle and including an axial hole defined through the pivot tube, the plate adapted to be fixed to a board, an axle extending through the axial hole in pivot tube and connected to a wheel frame, the wheel frame including a pivot portion which is located corresponding to the pivot tube, a passage defined axially through the pivot portion, an extension extending from the pivot portion and two shafts extending from two sides of the extension, the two shafts adapted to be connected with two wheels, a rod extending from a surface of the extension, a common axis of the two shafts located at a distance from the pivot tube, and an adjustment unit including a first part, a second part and a spring, the second part extending through the through hole and the first part threadedly connected to the second part, the second part including an aperture, a U-shaped first restriction member extending through the spring and the aperture and two hook ends of the first restriction member being hooked to a first end of the spring, a U-shaped second restriction member extending through the spring and two hook ends of the second restriction member being hooked to a second end of the spring, a U-shaped portion of the second restriction member engaged with the rod on the extension, the first part including an operation portion at a first end thereof and the operation portion including an inner threaded hole, the second part having outer threads which are threadedly connected with the inner threaded hole of the first part, a U-shaped portion of the first restriction member extending through the aperture of the second part which moves linearly when rotating the first part so as to change a length of the spring.

8. The turning mechanism as claimed in claim 7, wherein a buffering ring is located between the first part and the plate.

9. The turning mechanism as claimed in claim 8, wherein the rod includes a groove defined in an outer periphery of a distal end thereof and the U-shaped portion of the second restriction member is engaged with the groove.

10. The turning mechanism as claimed in claim 9, wherein a collar is engaged with the groove of the rod and includes an annular groove defined in an outer periphery thereof, the U-shaped portion of the second restriction member is engaged with the annular groove.

11. The turning mechanism as claimed in claim 9, wherein a stop extends axially from the pivot portion so as to restrict an angle that the wheel frame turns relative to the plate.

12. The turning mechanism as claimed in claim 7, wherein the operation portion is a locking nut.

13. A turning mechanism for skateboards, comprising:

a plate having a lug extending from a surface thereof and a through hole defined through the lug, a pivot tube extending from the surface of the plate at an angle and including an axial hole defined through the pivot tube, the plate adapted to be fixed to a board, an axle extending through the axial hole in pivot tube and connected to a wheel frame, the wheel frame including a pivot portion which is located corresponding to the pivot tube, a passage defined axially through the pivot portion, an extension extending from the pivot portion and two shafts extending from two sides of the extension, the two shafts adapted to be connected with two wheels, a rod extending from a surface of the extension, a common axis of the two shafts located at a distance from the pivot tube, and an adjustment unit including a first part, a second part and a spring, the second part extending through the through hole and the first part threadedly connected to the second part, a U-shaped restriction member extending through the spring and two hook ends of the restriction member being hooked to an end of the spring, a U-shaped portion of the second restriction member being engaged with the rod on the extension, the first part including an operation portion at a first end thereof and the operation portion including an inner threaded hole, the second part having outer threads which are threadedly connected with the inner threaded hole of the first part, the second part including a flange at an end thereof and the other end of the spring contacting the flange, the second part moving linearly when rotating the first part so as to change a length of the spring.

14. The turning mechanism as claimed in claim 13, wherein a buffering ring is located between the first part and the plate.

15. The turning mechanism as claimed in claim 14, wherein the rod includes a groove defined in an outer periphery of a distal end thereof and the U-shaped portion of the second restriction member is engaged with the groove.

16. The turning mechanism as claimed in claim 15, wherein a collar is engaged with the groove of the rod and includes an annular groove defined in an outer periphery thereof, the U-shaped portion of the second restriction member is engaged with the annular groove.

17. The turning mechanism as claimed in claim 15, wherein a stop extends axially from the pivot portion so as to restrict an angle that the wheel frame turns relative to the plate.

18. The turning mechanism as claimed in claim 13, wherein the operation portion is a slot.

19. The turning mechanism as claimed in claim 13, wherein the flange includes a recess defined in a surface thereof and the spring is engaged with the recess.

* * * * *